United States Patent [19]

Hackelsberger

[11] Patent Number: 4,629,084

[45] Date of Patent: Dec. 16, 1986

[54] CLOSURE FOR CANNING GLASS CONTAINER WITH GLASS COVER

[76] Inventor: Franzjosef Hackelsberger, Wehrtalstr. 6, 7867 Wehr, Fed. Rep. of Germany

[21] Appl. No.: 685,771

[22] Filed: Dec. 17, 1984

Related U.S. Application Data

[63] Continuation-in-part of Ser. No. 449,495, Dec. 13, 1982, abandoned.

[30] Foreign Application Priority Data

Dec. 15, 1981 [DE] Fed. Rep. of Germany ..... 3149558
May 18, 1982 [DE] Fed. Rep. of Germany ..... 3218717

[51] Int. Cl.[4] ..... B65D 53/04; B65D 21/00

[52] U.S. Cl. ..... 215/346; 206/508; 215/10; 215/262; 215/290; 215/293; 215/352; 220/231; 220/374

[58] Field of Search ..... 215/10, 256, 341, 355, 215/364, 262, DIG. 1, 287, 289, 290, 293, 346, 352; 220/231, 324, 326, 378, 469, 379; 206/508

[56] References Cited

U.S. PATENT DOCUMENTS

| | | | |
|---|---|---|---|
| 681,871 | 9/1901 | Burdick | 215/290 X |
| 730,903 | 6/1903 | Gibson | 215/289 |
| 731,792 | 6/1903 | Kunkel | 215/290 |
| 1,985,998 | 1/1935 | Koch et al. | 206/508 X |
| 2,036,125 | 3/1936 | Davis | 215/345 X |
| 2,281,433 | 4/1942 | Gunn | 215/290 |
| 2,693,307 | 11/1954 | Goodwin | 206/508 |
| 3,555,663 | 1/1971 | Forman | 220/378 X |
| 3,991,897 | 11/1976 | Meyers | 215/262 X |

FOREIGN PATENT DOCUMENTS

| | | | |
|---|---|---|---|
| 902213 | 1/1954 | Fed. Rep. of Germany | 215/290 |
| 639511 | 6/1950 | United Kingdom | 215/290 |

*Primary Examiner*—William Price
*Assistant Examiner*—Bryon Gehman
*Attorney, Agent, or Firm*—Michael J. Striker

[57] ABSTRACT

A closure for a canning glass container with a glass cover and a rubber ring therebetween has an upper rim which is formed in the container and provided with a sealing lip with a wedge having a tip with a radius of curvature between 1 mm and 3 mm, a supporting rim formed in the glass cover and having a circular depression located opposite to the wedge and having a radius of curvature exceeding the radius of curvature of the wedge with the wedge and the circular depression extending over an angle of approximately 110°-70°, and a projection formed in the glass cover at its side facing toward the canning glass container and provided with a circular outer edge arranged so that it laterally limits the supporting rim of the canning glass container, centers and holds the rubber ring and centers the glass cover in an inner edge of the canning glass container so that relative displacement of the glass cover and the canning glass container which can hinder closing of the latter, is excluded.

8 Claims, 5 Drawing Figures

CLOSURE FOR CANNING GLASS CONTAINER WITH GLASS COVER

CROSS-REFERENCE TO RELATED APPLICATION

This application is a continuation-in-part of application Ser. No. 449,495 filed on Dec. 13, 1982 now abandoned.

BACKGROUND OF THE INVENTION

The present invention relates to a closure for a canning glass container with a glass cover. More particularly it relates to a closure for a canning glass container with a glass cover and also with a rubber ring which extends over an opening rim of the container, projects outwardly, is located between the canning glass container and the glass cover, and is removable in a radial direction by hand. Only during canning a clamp is provided which abuts against a lower side of the flange of the canning glass container and the upper side of the glass cover, and the cover is pressed with interposition of the rubber ring against the upper circular rim of the canning glass container.

Canning glass containers of the above mentioned general type are known in the art. Some of such containers is disclosed, for example in the U.S. Pat. No. 3,991,897. The upper rim of the container disclosed in this reference has a cross-section which is rounded so as to form a semi-circular surface. The glass cover has a supporting rim. The upper rim of the container engages deeply into the rubber ring to suppress great forces. Since the glass cover after its manufacture is somewhat distorted after cooling and each glass cover is not tested, with this solution the supporting rim of the glass cover must be grinded.

Another canning glass container in the U.S. Pat. No. 3,519,159. Here, the upper circular rim is provided with a circular raised part which extends in a cross-section over an angular region of approximately 180°. A cover of this container is formed as a screw cover and composed of metal. A ring seal arranged between the upper rim of the container and the screw cover has a great thickness so that the upper rim of the container can deeply engage into the seal. This requires high forces which can be provided only by a screw cover. This construction is therefore not suitable for a canning glass container with a glass cover and with a rubber ring removable by hand.

SUMMARY OF THE INVENTION

Accordingly, it is an object of the present invention to provide a canning glass container with a glass cover and a rubber ring therebetween which avoids the disadvantages of the prior art.

More particularly, it is an object of the present invention to provide a canning glass container with a glass cover which is simple to manufacture and provides for a reliable closing extending over several years and releasable by slight pulling of the rubber ring.

In keeping with these objects and with others which will become apparent hereinafter, one feature of the present invention resides, briefly stated, in a closure for a canning glass container in which an upper rim of the container has a sealing lip which in its section is formed as a strongly rounded wedge with a rounded wedge tip having a radius of curvature of substantially between 1 mm and 3 mm, and a supporting rim formed in the cover and provided with a circular depression having a cross-section with a radius of curvature exceeding the radius of curvature of the wedge, the wedge tip in the rim of the container is produced during the manufacture of the container and the depression in the supporting rim of the glass cover is produced during the manufacture of the glass cover by pressing, the wedge tip of the container and the depression of the cover have a cross-section with circular line extending over an angular region of respectively 110°–70°, and the projection is formed on the cover at its side facing toward the container so that a circular outer edge of the projection laterally limits the supporting rim of the cover, centers and holds the rubber ring, and centers the cover in an inner edge of the container, so as to prevent relative displacement of the cover and the container which can otherwise hinder closing of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
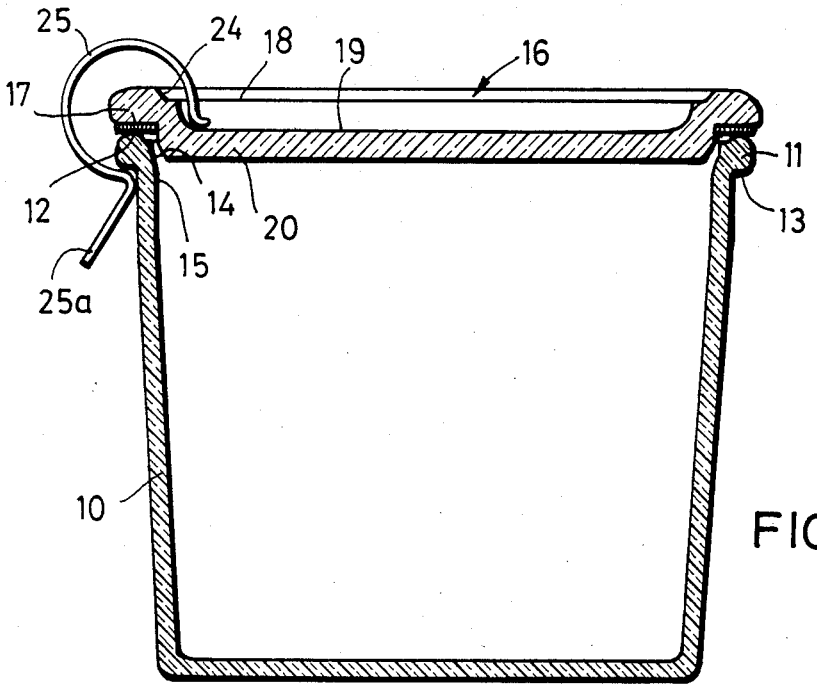
FIG. 1 is a sectioned side view of a canning glass container with a glass cover, a rubber ring and a holding clamp.

FIG. 1 shows a canning glass container 10. This container can have different widths, heights and shapes of its inner chamber, differing from those of the containers shown in FIG. 1. It can be produced by a press-blow process and have an upper indented opening edge. It is advantageous to form the container as shown in FIG. 1, since it provides for easy filling of the container with the product to be canned and also easy removal of a glass cover of the container.

The container 10 has an upper circular rim 11 provided with an outwardly directed flange and a circular sealing lip at its upper side. The lip 12 has a cross-section shown as an upwardly rounded wedge. This can be clearly seen from FIGS. 4 and 5, which show the upper wedge-shaped rim of the container, a glass cover, and a rubber ring located therebetween on a considerably enlarged scale.

The above described sealing lip of the container provides for the utilization of the container with advantage that after filling of the product to be canned it can be cleaned fast and without any residual matter and thereby an increased safety for closing of the container is provided. At the same time this sealing lip which is not conventional for the container for canning, has the advantage that it is resistable against damage of its sealing rim, and rim damage when it does occur can be easily recognized by simple and continuous feeling with a finger. The rim 11 with the wedge 12 being produced during production of the canning glass container by a press-blow process. Thereby, no working by grinding of it is required. In general damage for the sealing functions is effective only when it takes place to a great extent.

A curved circumferential surface 12*a* on the flange 7 immediately follows the sealing lip of the container with the significantly rounded wedge 12. A side surface 11*a* with a rounded edge 11*b* follows the surface 12*a* and transits into a lower horizontal supporting surface 13 for a holding clamp.

Finally, an inner cylindrical portion 14 has a rounded wedge-shaped upper side of the rim 11 at an inner edge. The cylindrical portion 14 is connected with an inclined portion 15 which is located hereinbelow and inclined in the region toward the interior of the container.

A cover 16 of glass is pressed with a glass press. It has a supporting rim 17 which extends in its plane and serves as a sealing surface as will be described in detail hereinbelow. The cover has also a first depression 18 pressed at its upper side laterally near the supporting rim 17, and a second depression 19. It is to be understood that both depressions can be produced with one plunger in one working step. The depression 19 forms a projection 20 provided at the lower side of the cover and having identical or approximately identical wall thickness.

A circumferential outer edge 21 of the projection 20 forms a side limit of the supporting rim 17 as well as a centering and holding edge for a rubber ring 22, as well as centering for the cover 16 of the inner edge 14, 15 of the container 10. Thereby the displacement between cover 16 and the container 10, which hinders a closure, is excluded. This means that the formation of the outer edge of the projection of the cover insertable into the container and the inner wall of the upper container rim can be manufactured with relatively low tolerances, i.e., small distances between the respective parts.

Figure 4:
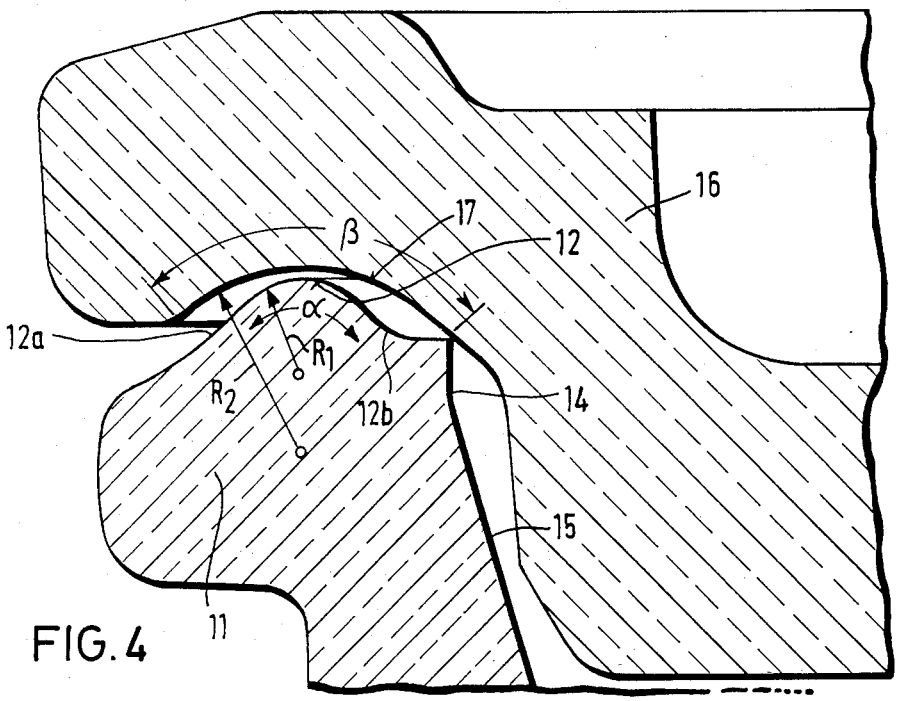
FIG. 4 is a partially vertical section of an upper rim of the glass container and a part of the supported glass cover with a circular depression and without the rubber ring, on an enlarged scale.

FIG. 4 shows the considerably rounded wedge 12 with an upper surface with a circular line in a cross-section, having a radius R1 equal to 1 and 3 mm. Advantageously, the radius R1 is equal to between 1.5 and 2 mm. This radius is provided for canning glass containers of all sizes. The circular line extends over an angle $\alpha$ of 110°–70°, advantageously approximately 90°. The surfaces 12*a* and 12*b* extending in opposite directions immediately follow the circular upper side of the wedge 12 at both its sides. In other words, it can be provided that the convex circular surface 12 as considered in cross-section is connected at its both sides with the concave surface 12*a* and 12*b*.

The cover 16 has a supporting surface formed as a depression 17, which surrounds the opposite wedge of the rim 11 of the container in a ring-like manner. This surface extends in its cross-section along a circular line with a radius R2 which also extends over an angle $\beta$ of 110°–70°, advantageously approximately 90°. The depression 17 is obtained by pressing the glass cover and not grinded.

Figure 5:
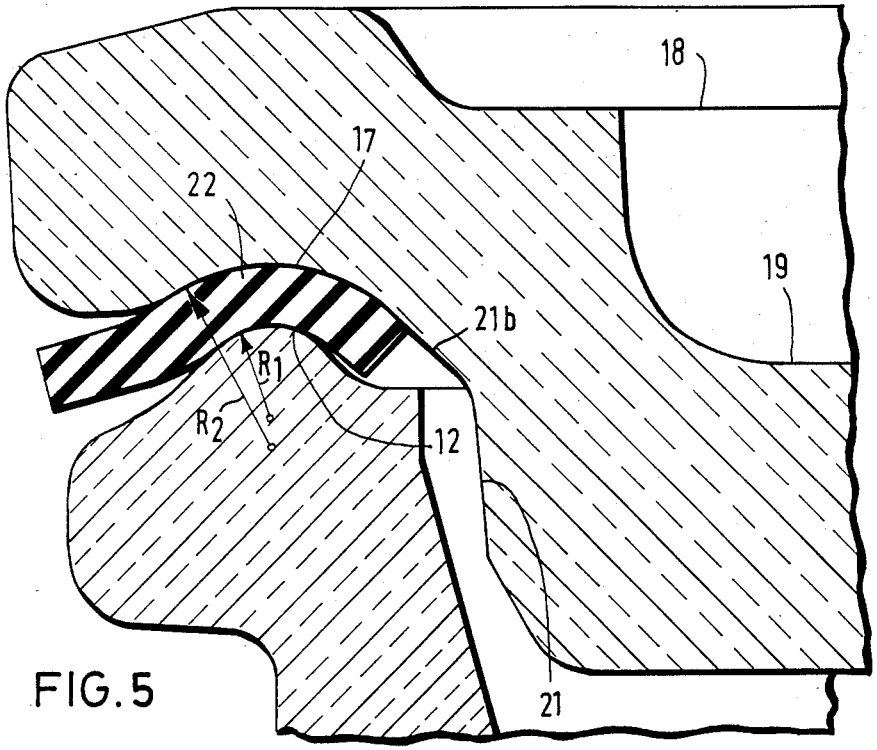
FIG. 5 is a view substantially corresponding to the view of FIG. 4 but with the rubber ring between the glass container and the glass cover.

As can be seen from FIG. 5, the rubber ring 22 is arranged between the wedge 12 and the depression 17. The wedge is partially pressed from below into the rubber ring 22. FIG. 5 also shows that the depression 17 presses the rubber ring around the wedge, so that a great supporting surface of the rubber ring on the wedge is available, which extends in accordance with FIG. 4 at the above mentioned angle $\alpha$. Since the rubber ring 22 has a ring-like abutment against the depression of the rim 17, it provides for a good sealing.

FIG. 5 shows that the surfaces 12*a* and 12*b* provided at both sides in connection with the rounded wedge, increase the receiving space for the rubber ring between the upper rim of the glass container and the supporting rim of the glass cover in a radial direction inwardly and outwardly and thereby makes it possible a deflection of the rubber ring into these increased spaces. Thereby, the penetration of the wedge tip into the rubber of the ring is also possible with low forces, since the displaced portion of the rubber can deflect into the free spaces. Since the rubber ring is surrounded by the circular depression in the cover, around the rounded wedge tip, only small penetration of the wedge into the rubber mass is needed for sealing. Because of this surrounding, a sufficiently dimensioned supporting surface is provided which allows also small damages in the circular wedge. Also, this system leads to the fact that the glass container rim does not have to be grinded.

In spite of the fact that the rubber ring has a curved shape to follow in a ring-like manner the shape of the wedge 12 and the depression of the rim 17, it can be pulled off by hand despite high sealing, very simple and very low force application.

The radius R1 of the convex upper surface of the wedge 12 is equal in this embodiment to 1.5 mm. With the thickness of the rubber ring of 1 mm, the radius R2 of the concavely curved upper surface of the recess of the rim 17 is equal to 3 mm, so that the radius of curvature R2 of the depression in the glass cover is greater than the radius of curvature R1 of the wedge plus the thickness of the rubber ring 22.

Reference numeral 22 identifies a region provided in the rubber ring for pulling off by hand. The projection 21 which is formed by the depression at the upper side of the glass cover and inserted into the glass container is formed so deep that the properly dimensioned rubber ring cannot slide off from the wall 21*b* so that the housewife can place during canning step the cover with the ring by a simple hand grip. Reference numeral 21*a* identifies a centering cone of the cover.

Figure 2:
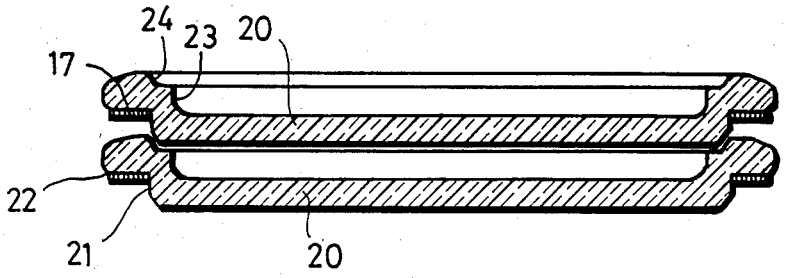
FIG. 2 is a view showing a vertical section of two stacked covers with rubber rings.
Figure 3:
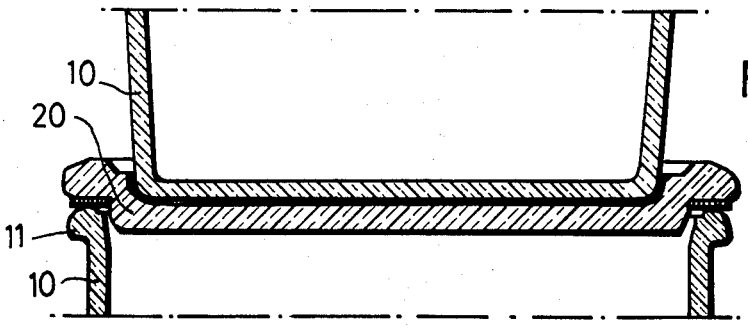
FIG. 3 is a vertical section of a partially shown glass container placed on the glass cover of the downwardly located glass container.

The centering cone 21 which is formed as a depression at the outer side of the cover and imparts a new shape to the cover provides for several additional functions. The depression 18 makes possible, after previous cleaning of the cover in hot water and subsequent placement in preparation for canning, nesting of the covers as shown in FIG. 2 for space economical and damage-free arrangement of the loose covers for their storage in a household. The depression 19 also makes possible a slide-free and storage-economical placement of the container in the canning pot or in the case of industrial canning in autoclaves. Thereby, improved space utilization of the boiler and improved energy utilization are achieved. There is also an advantage to arrange the container in a stack in the case of storage in households or placement on shelves in commercial sales.

Contrary to the known covers which have an additional so-called head chamber above the canned products, the inventive cover has, because of the depressions 18 and 19, a centering cone extending into the container and providing a considerable decrease of the head chamber in the latter. Thereby the oxygen quantity about the canned product, which conventionally results in oxidation of the vitamin contents and decrease in the quality of taste and appearance of the canned products, it considerably reduced.

A further advantage of the provisions of the depressions 18 and 19 in the cover is that a substantially vertical side wall 23, or the bottom of the depression 19 connected therewith, or a substantially vertical wall 24, or the directly connected bottom of the depression 18 provide together with the undercut 13 at the lower side of the rim 11 a good support and hold for operation securing spring clamps 25. The latter can be composed, for example, of a spring steel or springy synthetic plastic material. Two such spring clamps are sufficient, as a rule, for canning processes.

The depression in the upper side of the cover leads during the production and subsequent cooling to the fact that the cover is very shape-stable because of the shape obtained thereby, and as a result of this the surface 17 of the rubber ring support remains free from deformation and in its initial form. Thereby, no working by grinding of it is required.

With the inventive construction it is attained that the depression 19 pressed in the glass cover reduces the upper head chamber of the canning glass container during placement of the glass cover on the rim 12 of the container. Thereby a lower quantity of oxygen is available above the canned product, so that the canned product cannot be oxidized or is oxidized very little.

The rim of the cover inserted into the canning glass container protects the closure since the lower side of the cover lies deeper than the closure. Thereby during canning with boiling of the canned product it does not reach the region of the sealing by the upper circularly rounded wedge of the glass rim, the rubber ring and the supporting surface of the glass cover. In contrast, water vapor produced during canning reaches this region and through the closure can escape in the inventive construction.

It will be understood that each of the elements described above, or two or more together, may also find a useful application in other types of constructions differing from the types described above.

While the invention has been illustrated and described as embodied in a closure for canning glass container with glass cover, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A closure for a canning glass container having an inner edge and provided with a glass cover, a rubber ring located between the canning glass container and the glass cover and removable in a radial direction by hand, and a clamp connecting the glass cover with the canning glass container only during canning so as to press the glass cover against the canning glass container with interposition of the rubber ring and removed from the container afterwards after a negative pressure is formed in the interior of the canning glass container, the closure comprising an upper circular rim formed in the canning glass container and provided with a sealing lip which extends upwardly from said upper rim and in its cross-section is formed as a considerably rounded convex wedge; a supporting rim formed in the glass cover opposite to said upper rim of the canning glass container and having a conave circular depression located opposite to said convex wedge, said rubber ring having a predetermined thickness, and said concave circular depression having a cross-section with a radius of curvature exceeding the radius of curvature of said convex wedge plus the thickness of said rubber ring so that a receiving space for the rubber ring between said convex wedge and said concave depression increases from a central vertical axis of said convex wedge and said concave depression in opposite directions, said convex wedge in said upper rim of the canning glass container being press-produced during production of the canning glass container and said concave depression in said supporting rim of the glass cover being press-produced during production of the glass cover, said convex wedge and said concave circular depression each having a surface with a circular line extending over an angle of approximately of 70°–110°.

2. A closure as defined in claim 1, wherein the thickness of the rubber ring is 1 mm, the radius of curvature of circular line of the surface of said wedge being equal to approximately 1.5 mm, and the radius of curvature of the circular line of the surface of the circular depression being equal to approximately 3 mm.

3. A closure as defined in claim 1, wherein said tip of said convex wedge has a radius of curvature of between 1 mm and 2 mm, said concave depression having a radius of curvature of between 2.5 and 4 mm.

4. A closure as defined in claim 1, wherein the glass cover has an upper side and a further depression pressed in the upper side and extending downwardly so as to retain in the cover a substantially uniform wall thickness and to form in the cover at its lower side said projection.

5. A closure as defined in claim 4, wherein the glass cover has a lower side formed by said further depression and located deeper than said supporting rim of the glass cover, so as to limit a head chamber of the canning glass container from above, therefore said convex wedge of the canning glass container together with the rubber ring and with said supporting rim of the glass cover and during canning step is arranged in a protective manner above a product which is canned in the canning glass container and allows a water vapor to escape through the closure.

6. A closure as defined in claim 5, wherein said further depression includes two stepped depressions provided in the cover at its upper side and formed so that one of said depressions is arranged above the other depression and has a greater diameter and a smaller depth, whereas the other of said depression is arranged below the one depression and has a smaller diameter and a greater depth, the canning glass container having a lower rim with a predetermined outer diameter, said projection of said supporting rim of the glass cover having a predetermined outer diameter, said one depression having a diameter which is insignificantly greater than the outer diameter of said projection of said supporting rim of the glass cover, said other depression having a diameter which is insignificantly greater than the outer diameter of said lower rim of the canning glass container.

7. A closure as defined in claim 1; and further comprising a projection formed in the glass cover at its side facing toward the canning glass container, said projection having a circular outer edge arranged so that it laterally limits said supporting rim, centers and holds the rubber ring and centers the glass cover in the inner edge of the canning glass container, so that relative displacement of the glass cover and the canning glass container, which can hinder closing of the latter, is excluded.

8. A closure as defined in claim 7, wherein said projection has a centering cone and above said centering cone merges in a substantially cylindrical flat portion which merges into said concave depression in said supporting rim of the cover.

* * * * *